US005396787A

United States Patent [19]

Kanemitsu et al.

[11] Patent Number: 5,396,787

[45] Date of Patent: Mar. 14, 1995

[54] METHOD OF PRODUCING FLUID-CHAMBER COMPONENT ELEMENTS

[75] Inventors: Toshiaki Kanemitsu, Kobe; Kazuyuki Oda, Kako, both of Japan

[73] Assignee: Kabushiki Kaisha Kanemitsu, Akashi, Japan

[21] Appl. No.: 291,722

[22] Filed: Aug. 16, 1994

Related U.S. Application Data

[63] Continuation of Ser. No. 829,003, Mar. 9, 1992, abandoned.

[51] Int. Cl.[6] ..... B21H 1/04

[52] U.S. Cl. ..... 72/111; 29/888.049; 29/893.32

[58] Field of Search ..... 29/888.04, 888.049, 29/892, 892.3, 893.32, 893.36, 894.324; 72/68, 82, 102

[56] References Cited

U.S. PATENT DOCUMENTS 3,999,416 12/1976 Brooks ..... 72/69

FOREIGN PATENT DOCUMENTS 2045665 11/1980 United Kingdom ..... 29/893.32

*Primary Examiner*—Lowell A. Larson

*Attorney, Agent, or Firm*—Jones, Tullar & Cooper

[57] ABSTRACT

To form a seal ring groove in the outer peripheral surface of a steel plate having a circular contour, the present invention provides a method of producing fluid-chamber component elements by which the peripheral portion of the steel plate held by and between a pair of rotary molds is thickened with the use of a roller before the seal ring groove is formed. According to the method of the present invention, a preliminary thickened portion is first formed at the peripheral portion of the steel plate. Then, there is formed, at the outer peripheral surface of the steel plate, a final thickened portion having such a thickness that the seal ring groove can be formed therein. This prevents the steel plate from being buckling by a pushing force applied by a roller at the time when forming the final thickened portion.

4 Claims, 3 Drawing Sheets

METHOD OF PRODUCING FLUID-CHAMBER COMPONENT ELEMENTS

This is a continuation of application Ser. No. 07/829,003, filed on Mar. 1992, now abandoned.

FIELD OF THE ART

The present invention relates to a method of producing component elements of a fluid chamber in which a fluid such as oil or the like used in a speed change gear of a motor vehicle for example, is sealed and more particularly to a method of producing fluid-chamber component elements each provided in the outer peripheral surface thereof with a seal ring groove.

BACKGROUND OF THE INVENTION

The fluid-chamber component elements mentioned above may be used, for example, as component elements of a working oil chamber 136, 174, 512 in a stepless speed change gear disclosed by Japanese Utility Model Laid-Open Publication No. 64-41757. Conventionally, such fluid-chamber component elements have been generally made by die casting.

However, such die-cast fluid-chamber component elements present the problem that the component elements have to be made relatively thick in order to have the necessary strength. Further, die casting requires complicated facilities, thus disadvantageously increasing the cost.

As a method which overcomes the problems mentioned above, there has been proposed a method of producing a disk-like piston obtainable by forming a seal ring groove in the peripheral portion of a blank disk using a roller, as disclosed by Japanese Patent Laid-Open Publication No. 63-72441. As shown in FIG. 6, the producing method above-mentioned comprises the steps of holding a blank 100 by and between a pair of rotary molds A', B', thickening the peripheral portion 101 of the blank 100 with a roller C' and forming a seal ring groove 102 in the outer peripheral surface of the peripheral portion 101 thus thickened.

If the blank 100 is thin when producing a fluid-chamber component element by the method mentioned above, the blank 100 is disadvantageously buckled by the peripheral portions of the rotary molds A', B' holding the blank 100 when a pressure is applied to the outer peripheral surface of the blank 100 by the roller C'.

SUMMARY OF THE INVENTION

In view of the foregoing, the present invention has as an object providing a method of producing fluid-chamber component elements which prevents a blank, even a thin blank, from being buckled as happens in the conventional method mentioned earlier, even though the present method is a method of forming a seal ring groove in the outer peripheral surface of the blank with a roller.

To achieve the object mentioned above, the method of producing fluid-chamber component elements according to the present invention includes the steps of fixing a steel plate having a circular contour to a rotary mold unit, thickening the peripheral portion of the steel plate with the use of a roller rotated in the opposite direction to the directions of rotation of the rotary mold unit, and forming a seal ring groove in the outer peripheral surface of the peripheral portion thus thickened, the method comprising the steps of:

forming, in the vicinity of the peripheral portion of the steel plate, a preliminary thickened portion of which the greatest thickness is smaller than that at the time a seal ring groove is formed;

further thickening the peripheral portion of the steel plate including the preliminary thickened portion, thereby forming a final thickened portion; and forming a seal ring groove in the outer peripheral surface of the final thickened portion.

According to the method mentioned above, the final thickened portion is formed after the steel plate in the vicinity of the peripheral portion thereof has been improved in strength. This prevents the steel plate from buckling by a pressure applied thereto at the time of forming the final thickened portion.

According to the method of producing fluid-chamber component elements of the present invention, the preliminary thickened portion is formed at the steel plate at its portion corresponding to the peripheral edge of the rotary mold unit which fixes the steel plate. This improves the strength of the steel plate at its portion which is particularly liable to be buckled.

DETAILED DESCRIPTION OF THE PREFERRED EMBODIMENTS

(1) Preliminary Thickening Step

Figure 1A:
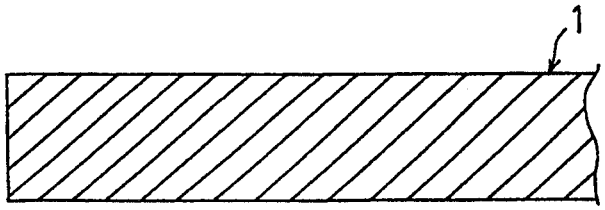
FIG. 1A is an enlarged section view of the peripheral portion of a steel plate molded in the form of a circle.
Figure 3:
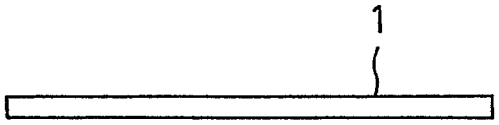
FIG. 3 is a section view of an example of the entire shape of the steel plate.
Figure 4:
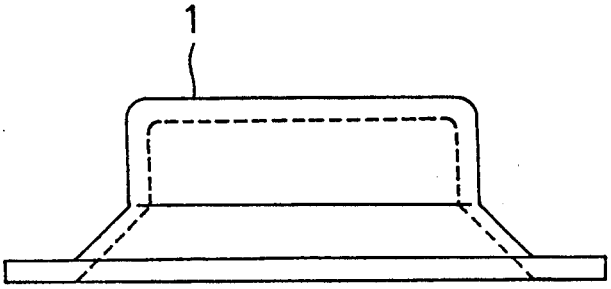
FIG. 4 is a section view of another example of the entire shape of the steel plate.

First, there is prepared a steel plate 1 the peripheral portion of which has a flat section as shown in FIG. 1A. Generally, the steel plate 1 is a disk-like plate as shown in FIG. 3 and has a thickness of 2.0 mm for example. Alternatively, the steel plate 1 may be a flanged cup-shaped member as shown in FIG. 4. In any case, the outer periphery of the steel plate 1 is made in the form of a circle.

Figure 2A:
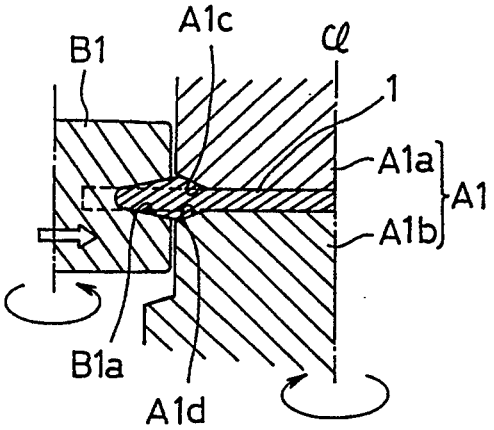
FIG. 2A is a view illustrating the step of forming a preliminary thickened portion.

As shown in FIG. 2A, the steel plate 1 is held by and between an upper mold A1*a* and a lower mold A1*b* of a preliminary thickening rotary mold unit A1. The preliminary thickening rotary mold unit A1 can be rotated around an axis of rotation cl identical with the axis of the steel plate 1. The upper mold A1*a* and the lower mold A1*b* hold the steel plate 1 with the peripheral portion of the steel plate 1 projecting by a predetermined amount from the peripheral portions of the upper mold A1*a* and the lower mold A1*b*. The upper mold A1*a* and the lower mold A1*b* are respectively provided at the peripheral portions thereof with tapering surfaces A1*c*, A1*d*, the distance between which becomes greater in the direction toward the peripheral edges of the molds A1*a*, A1*b*. The gradients of the tapering surfaces A1*c*, A1*d* are formed such that the distance between the peripheral edges of the upper mold A1*a* and the lower mold A1*b* at the time when the steel plate 1 is held thereby and therebetween, is smaller than the thickness of a final thickened portion 12 of the steel plate 1 at the time when a seal ring groove is formed therein, as will be discussed later.

Figure 1B:
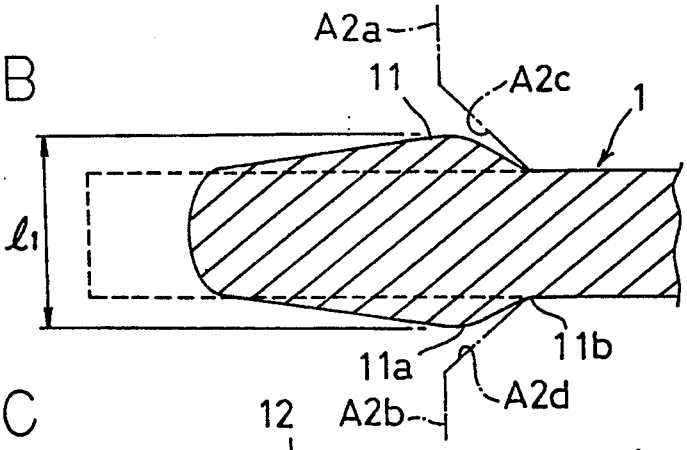
FIG. 1B is an enlarged section view of that peripheral portion of the steel plate at which a preliminary the thickened portion is formed.

Then, the outer peripheral surface of a preliminary thickening roller B1 is applied to the peripheral portion of the steel plate 1 held by the preliminary thickening rotary mold unit A1. More specifically, a substantially V-shaped groove B1*a* is formed in the outer peripheral surface of the preliminary thickening roller B1. The peripheral portion of the steel plate 1 projecting from the peripheral edge of the preliminary thickening rotary mold unit A1 is inserted into the V-shaped groove B1*a*. As shown in FIG. 2A, the roller B1 is pushed to the rotary mold unit A1 while the rotary mold unit A1 and the roller B1 are respectively rotated in the opposite directions. As shown in FIG. 1B, a preliminary thickened portion 11 is formed at the peripheral portion of the steel plate 1. As shown in FIG. 1B, while the original thickness of the steel plate 1 is substantially maintained at the peripheral edge of the preliminary thickened portion 11, the preliminary thickened portion 11 is gradually inclined and increased in thickness in the direction toward the center portion of the steel plate 1, and the most thickened portion 11*a* is formed at the position corresponding to the peripheral edge of the preliminary thickening rotary mold unit A1. For example, when the steel plate 1 has a thickness of 2.0 mm as mentioned earlier, the thickness $l_1$ of the most thickened portion 11*a* may be made about 3.5 mm.

(2) Final Thickening Step

Figure 2B:
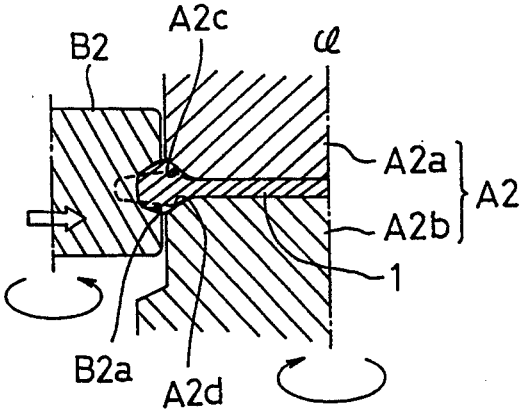
FIG. 2B is a view illustrating the step of forming a final thickened portion.

As shown in FIG. 2B, the steel plate 1 having the preliminary thickened portion 11 thus prepared is held by and between an upper mold A2*a* and a lower mold A2*b* of a final thickening rotary mold unit A2 adapted to be rotated around the axis of rotation cl. The upper and lower molds A2*a*, A2*b* are also provided at the peripheral portions thereof with tapering surfaces A2*c*, A2*d*, the distance between which becomes greater in the direction toward the peripheral edges of the molds A2*a*, A2*b*. The distance between the rising point of each tapering surface A2*c*, A2*d* and the axis of rotation cl is equal to the distance between the rising point of each tapering surface A1*c*, A1*d* and the axis of rotation cl. The gradients of the tapering surfaces A2*c*, A2*d* are greater than the gradients of the tapering surfaces A1*c*, A1*d*. Accordingly, when the steel plate 1 having the preliminary thickened portion 11 is held by and between the upper mold A2*a* and the lower mold A2*b*, the steel plate 1 is held with expansion starting points 11*b* of the preliminary thickened portion 11 being in accord with the rising points of the tapering surfaces A2*c*, A2*d*. The peripheral portion of the preliminary thickened portion 11 projects from the peripheral edge of the rotary mold unit A2.

Figure 1C:
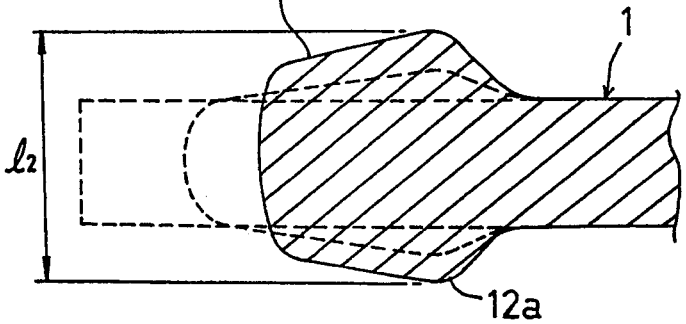
FIG. 1C is an enlarged section view of that peripheral portion of the steel plate at which a final thickened portion is formed.

Then, the outer peripheral surface of a final thickening roller B2 is applied to the peripheral portion of the steel plate 1, i.e., the peripheral portion of the preliminary thickened portion 11, held by the final thickening rotary mold unit A2. More specifically, a V-shaped groove B2*a* is formed in the outer peripheral surface of the final thickening roller B2, the V-shaped groove B2*a* being generally wider and narrower than the V-shaped groove B1*a*. The peripheral portion of the final thickened portion 11 is inserted into the V-shaped groove B2*a*. As shown in FIG. 2B, the roller B2 is pushed toward the rotary mold unit A2 while the rotary mold unit A2 and the roller B2 are respectively rotated in the opposite directions. As shown in FIG. 1C, a final thickened portion 12 is formed at the peripheral portion of the steel plate 1 such that the thickness $l_2$ of at least the most thickened portion 12*a* is equal to the final desired thickess. For example, when the original thickness of the steel plate 1 is equal to 2.0 mm, the desired thickness or the thickness $l_2$ of the most thickened portion 11*a* may reach 4.8 mm. Further, the peripheral portion of the final thickened portion 12 is thicker than the original thickness of the steel plate 1. Thus, the final thickened portion 12 has a thickness remarkably greater than the original thickness of the steel plate 1. It is therefore required that the roller B2 applies a remarkably great pushing force to the steel plate 1 when forming the final thickened portion 12.

According to the producing method of the present invention, there has been previously formed, at the preliminary thickening step, the preliminary thickened portion 11 having a thickness slightly greater than the original thickness of the steel plate 1. Therefore, the pushing force of the roller B2 can be received by the preliminary thickened portion 11 at the final thickening step. Thus, even though a remarkably great pushing force is applied by the roller B2, the steel plate 1 can be thickened without buckling.

(3) Preliminary Groove Forming Step

Figure 2C:
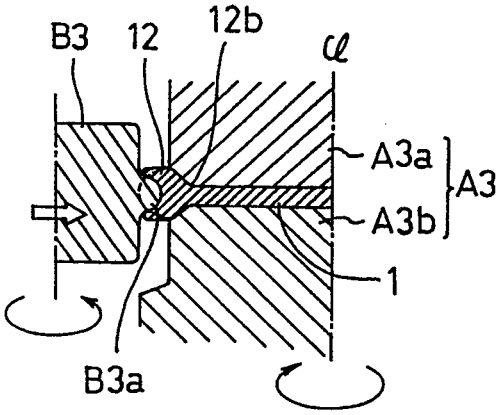
FIG. 2C is a view illustrating the step of forming a preliminary groove.

As shown in FIG. 2C, the steel plate 1 is held by and between the upper mold A3*a* and lower mold A3*b* of a preliminary groove forming rotary mold unit A3 instead of the final thickening rotary mold unit A2. Also, the upper and lower molds A3*a*, A3*b* are rotated around the axis of rotation cl. The upper and lower molds A3*a*, A3*b* fittingly hold a portion of the final thickened portion 12 including expansion starting portions 12*b* thereof. This regulates the final thickened portion 12 in movement toward the center of the steel plate 1. The peripheral portion of the final thickened portion 12 project from the peripheral edges of the preliminary groove forming rotary mold unit A3.

Figure 1D:
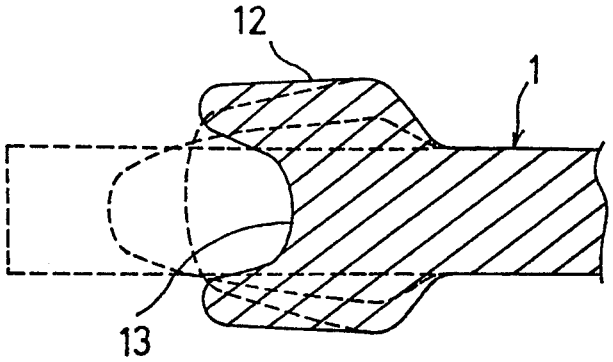
FIG. 1D is an enlarged section view of that peripheral portion of the steel plate in which a preliminary groove is formed.

As also shown in FIG. 2C, a preliminary groove 13 as shown in FIG. 1D is formed in the outer peripheral surface of the steel plate 1, i.e., the outer peripheral surface of the final thickened portion 12, with the use of a preliminary groove forming roller B3 provided on the outer peripheral surface thereof with a projection B3*a* having a mountain-shape section. More specifically, while the mold unit A3 and the roller B3 are respectively rotated in the opposite directions as shown in FIG. 2C, the roller B3 is pushed to the outer peripheral surface of the final thickened portion 12, thereby forming the preliminary groove 13 smaller than a desired seal ring groove. This preliminary groove 13 is formed in order to facilitate the formation of the seal ring groove to be subsequently formed.

(4) Seal Ring Groove Forming Step

Figure 2D:
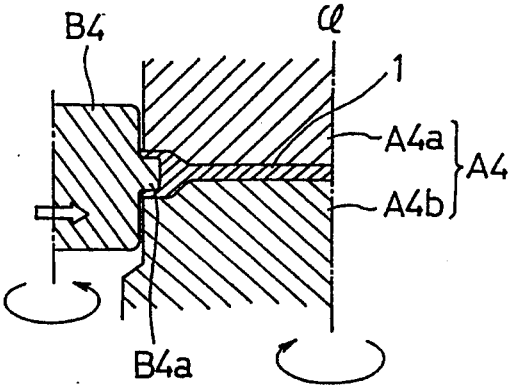
FIG. 2D is a view illustrating the step of finally forming a seal ring groove.

As shown in FIG. 2D, the steel plate 1 is held by and between the upper mold A4*a* and lower mold A4*b* of a seal ring groove forming rotary mold unit A4 instead of the preliminary groove forming rotary mold unit A3. Also, the upper and lower molds A4*a*, A4*b* are rotated around the axis of rotation cl. The upper and lower molds A4*a*, A4*b* hold the final thickened portion 12 of the steel plate 1 without the peripheral portion of the final thickened portion 12 projecting from the peripheral edges of the mold unit A4.

Figure 1E:
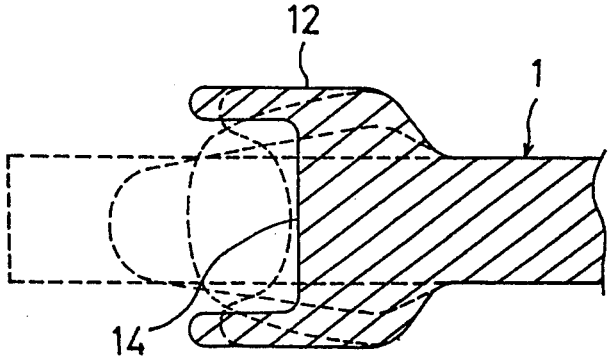
FIG. 1E is an enlarged section view of that peripheral portion of the steel plate in which a seal ring groove is formed.

A seal ring groove 14 as shown in FIG. 1E is formed in the outer peripheral surface of the steel plate 1 thus held by the mold unit A4, i.e., the outer peripheral surface of the final thickened portion 12, with the use of a seal ring groove forming roller B4. More specifically, the roller B4 is provided on the outer peripheral surface thereof with a projection B4*a* having a rectangular section. While the mold unit A4 and the roller B4 are respectively rotated in the opposite directions, the projection B4*a* is pushed to the preliminary groove 13 previously formed. The projection B4*a* expands the preliminary groove 13 to form the seal ring groove 14. When the preliminary groove 13 is expanded by the projection B4*a*, the peripheral portion of the final thickened portion 12 is apt to be expanded in such a direction that the thickness of the final thickened portion 12 is further increased. However, the thickness of the final thickened portion 12 is regulated to a predetermined thickness by the upper and lower molds A4*a*, A4*b*.

Figure 5:
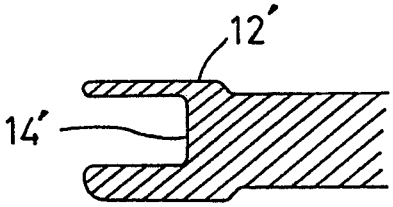
FIG. 5 is an enlarged view of main portions of another the seal ring groove.
Figure 6:
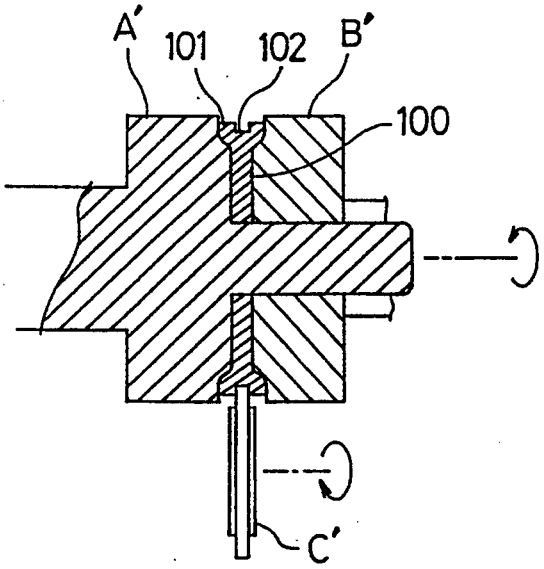
FIG. 6 is a schematic section view illustrating a conventional method of producing fluid-chamber component elements.

The seal ring groove is not necessarily formed in the center of the outer peripheral surface of the final thickened portion. That is, a seal ring groove 14' may be formed in the outer peripheral surface of the final thickened portion 12' at its portion nearer to the upper or lower end, as shown in FIG. 5.

In the embodiment mentioned above, there are successively formed, on the disk-like steel plate 1, the preliminary thickened portion 11, the final thickened portion 12, the preliminary groove 13 and the seal ring groove 14. However, the final thickened portion 12 may be first formed at the peripheral portion of the disk-like steel plate 1, which may then be bent and formed into a flanged cup shape, as shown in FIG. 4, in which a seal ring groove may then be formed.

Further, the method of forming the seal ring groove after the final thickened portion has been formed, may be suitably changed as necessary.

As thus discussed, according to the method of producing fluid-chamber component elements of the present invention, even a thin steel plate can be provided at the peripheral portion thereof with a thickened portion without the steel plate being buckled. Accordingly, the method of the present invention makes it possible to form, from a very thin steel plate, component elements such as working-oil chamber component elements 136, 174, 512 in Japanese Utility Model Laid-Open Publication No. 64-41757 mentioned earlier. The method of the present invention can be applied not only to the component elements mentioned above, but also to primer cylinder component elements in a speed change gear of a motor vehicle, for example.

What is claimed is:

1. A method of producing fluid-chamber component elements comprising the steps of: fixing a steel plate having a circular contour to a rotary mold unit having a peripheral portion for thickening the peripheral portion of the steel plate by pushing a roller rotated in a direction opposite to the direction of rotation of the rotary mold unit, and forming a seal ring groove in the outer peripheral surface of the peripheral portion thus thickened;

preliminary thickening that portion of the steel plate which corresponds to the peripheral portion of the rotary mold unit forming thereby a preliminary thickened portion the greatest thickness of which is smaller than the thickness at the step of forming a seal ring groove, said preliminary thickened portion having a tapered outer surface;

finally thickening said preliminary thickened portion thereby forming a final thickened portion having a tapered outer surface, said preliminary thickening and said final thickening being successively conducted at different steps with the use of different forming rollers and different forming molds such that the taper of the outer surface of the preliminary thickened portion is different from the taper of the same outer surface of the final thickened portion; and forming a seal ring groove in the outer peripheral surface of said final thickened portion.

2. A method of producing fluid-chamber component elements according to claim 1 wherein the steel plate is held by and between upper and lower molds of the rotary mold unit.

3. A method of producing fluid-chamber component elements according to claim 1, wherein the preliminary thickened portion is formed on the steel plate at its portion corresponding to the peripheral edge of the rotary mold unit which securely holds the steel plate.

4. A method of producing fluid-chamber component elements according to claim 3, wherein the steel plate is held by and between upper and lower molds of the rotary mold unit.

* * * * *